US006553583B1

(12) United States Patent
Pan

(10) Patent No.: US 6,553,583 B1
(45) Date of Patent: Apr. 29, 2003

(54) STOP VALVE FOR BASIN OR SEWER

(76) Inventor: Wen Cheng Pan, P.O. Box 10-69, Chong Ho, Taipei (TW), 235

( * ) Notice: Subject to any disclaimer, the term of this patent is extended or adjusted under 35 U.S.C. 154(b) by 0 days.

(21) Appl. No.: 10/062,417

(22) Filed: Feb. 5, 2002

(51) Int. Cl.[7] ..... A47K 1/04; E03C 1/26
(52) U.S. Cl. ..... 4/286; 4/287; 4/652
(58) Field of Search ..... 4/286–292, 650, 4/652, 688–690

(56) References Cited

U.S. PATENT DOCUMENTS 212,614 A * 2/1879 Magee ..... 4/289
1,204,316 A 11/1916 Renner
1,722,891 A 7/1929 Boosey
2,191,686 A * 2/1940 Shenk ..... 4/289
2,288,767 A * 7/1942 Young ..... 4/287

* cited by examiner

*Primary Examiner*—Gregory L. Huson
*Assistant Examiner*—Tuan Nguyen

(57) ABSTRACT

A stop valve device includes a container having an outlet opening, a valve controlled to open and to close the outlet opening of the container. A casing is received in the outlet opening of the container and includes a number of orifices for filtering purposes. A cover is engaged on top of the casing and includes a number of apertures for water flowing purposes. The cover includes one or more outward extending pins engaged in the grooves formed in the container for pivotally securing the cover to the container and for preventing over turning of the cover and the casing.

1 Claim, 5 Drawing Sheets

STOP VALVE FOR BASIN OR SEWER

BACKGROUND OF THE INVENTION

1. Field of the Invention

The present invention relates to a stop valve, and more particularly to a stop valve or a sewer trap assembly for basins or sewers, or the like.

2. Description of the Prior Art

Typical stop valves are provided for attaching to the basins, the bathtubs, the sewers, or the like. U.S. Pat. No. 1,722,891 to Boosey, and U.S. Pat. No. 1,204,316 to Renner disclose two of the typical stop valves for basins or sewers and comprise a valve member pivotally or rotatably secured in the draining outlet for collecting dirt. However, the valve member may not be easily removed from the basins or sewers, such that the collected dirt may not be easily cleaned.

The present invention has arisen to mitigate and/or obviate the afore-described disadvantages of the conventional stop valves.

SUMMARY OF THE INVENTION

The primary objective of the present invention is to provide a stop valve assembly for basins or sewers, or the like, including a configuration for allowing the collected dirt to be easily cleaned.

In accordance with one aspect of the invention, there is provided a stop valve assembly comprising a container including an outlet opening, a valve engaged in the outlet opening of the container, a casing received in the outlet opening of the container, and including a plurality of orifices formed therein for filtering purposes, and a cover engaged on top of the casing and including a plurality of apertures formed therein.

A device is further provided for pivotally securing the cover to the container, and includes at least one groove formed in the container, and at least one pin extended from the cover and engaged in the groove of the container.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
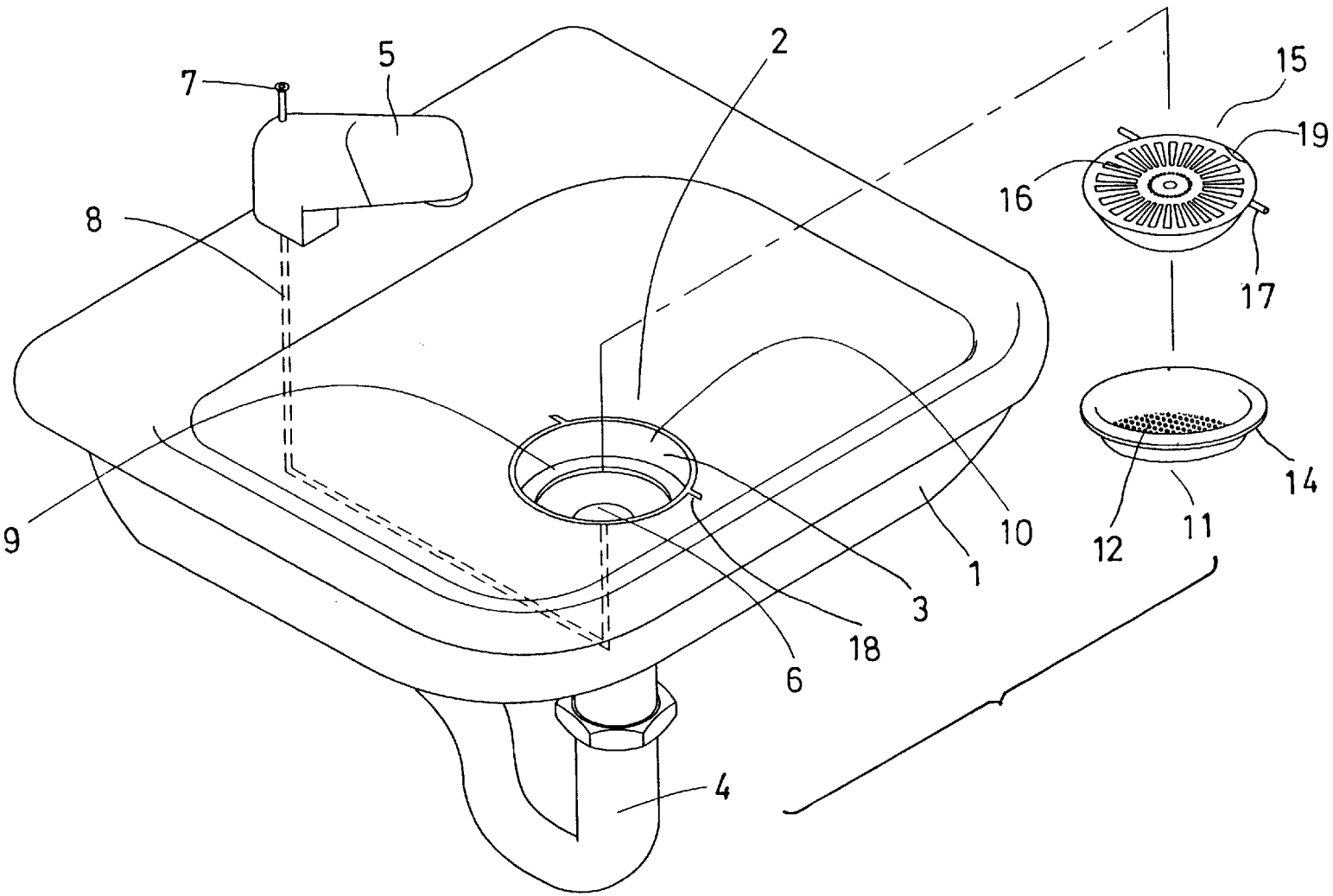
FIG. 1 is an exploded view of a stop valve assembly in accordance with the present invention.
Figure 2:
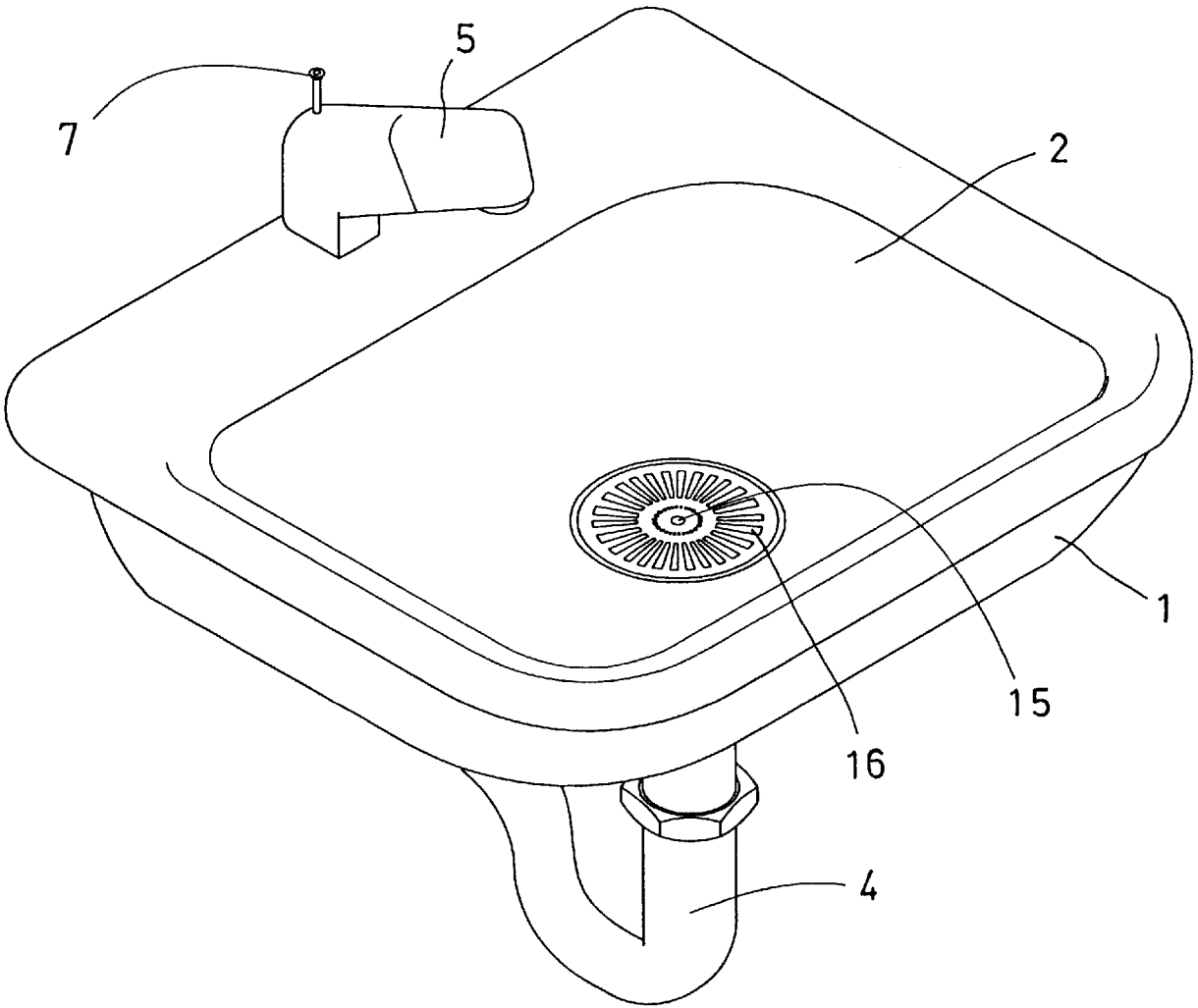
FIG. 2 is a perspective view of the stop valve assembly.
Figure 3:
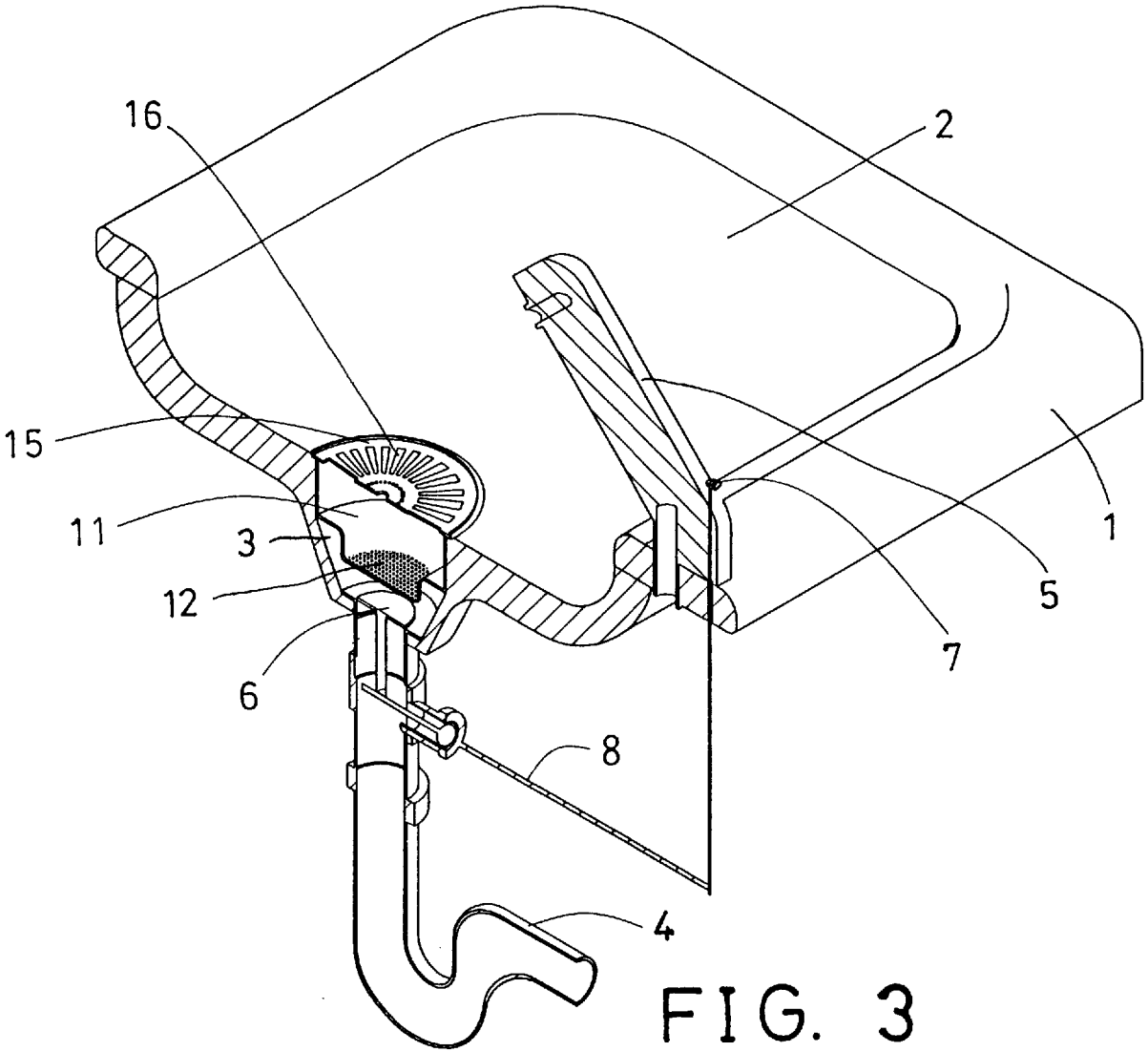
FIG. 3 is a partial perspective view of the stop valve assembly, in which one half of the stop valve assembly has been cut off for showing the inner structure of the stop valve assembly.

Referring to the drawings, and initially to FIGS. 1–3, a stop valve assembly in accordance with the present invention comprises a container 1, such as a basin, a bathtub, a sewer or the like, including a recess 2 formed in the upper portion thereof, and including an outlet opening 3 formed in the bottom portion thereof and communicating with the recess 2 thereof. An outlet pipe 4 has one end coupled to the outlet opening 3 of the container 1 for water draining purposes. One or more faucets 5 are attached on top of the container 1 for supplying cold and/or hot water into the container 1. A typical valve 6 is disposed and provided for selectively enclosing the outlet opening 3 of the container 1, and is coupled to an actuator 7 via a link 8 so as to be opened and controlled by the actuator 7. The outlet opening 3 of the container 1 may include a peripheral shoulder 9 formed therein and may be formed or defined by a peripheral wall 10.

The stop valve assembly further includes a casing 11 having an outer diameter corresponding to the outlet opening 3 or the peripheral wall 10 of the container 1, for being received in the outlet opening 3 of the container 1. The casing 11 may also be stably supported in place by the peripheral shoulder 9 of the container 1. The casing 11 includes a number of orifices 12 formed in the bottom and a peripheral flange 14 extended radially outward from the upper portion thereof for engaging with the container 1 and for allowing the upper portion of the casing 11 to be flush with the bottom surface of the container 1, best shown in FIGS. 2, 3.

A cover 15 is engaged on top of the casing 11, and includes a number of apertures 16 formed therein, and includes one or more pins 17 extended outward therefrom for engaging into the corresponding one or more grooves 18 of the container 1, and for allowing the cover 15 to be pivotally secured to the container 1 with the pins 17. The cover 15 includes one end having an indication or a knob 19 formed or provided therein, for indicating where the cover 15 is preferably depressed.

Figure 4:
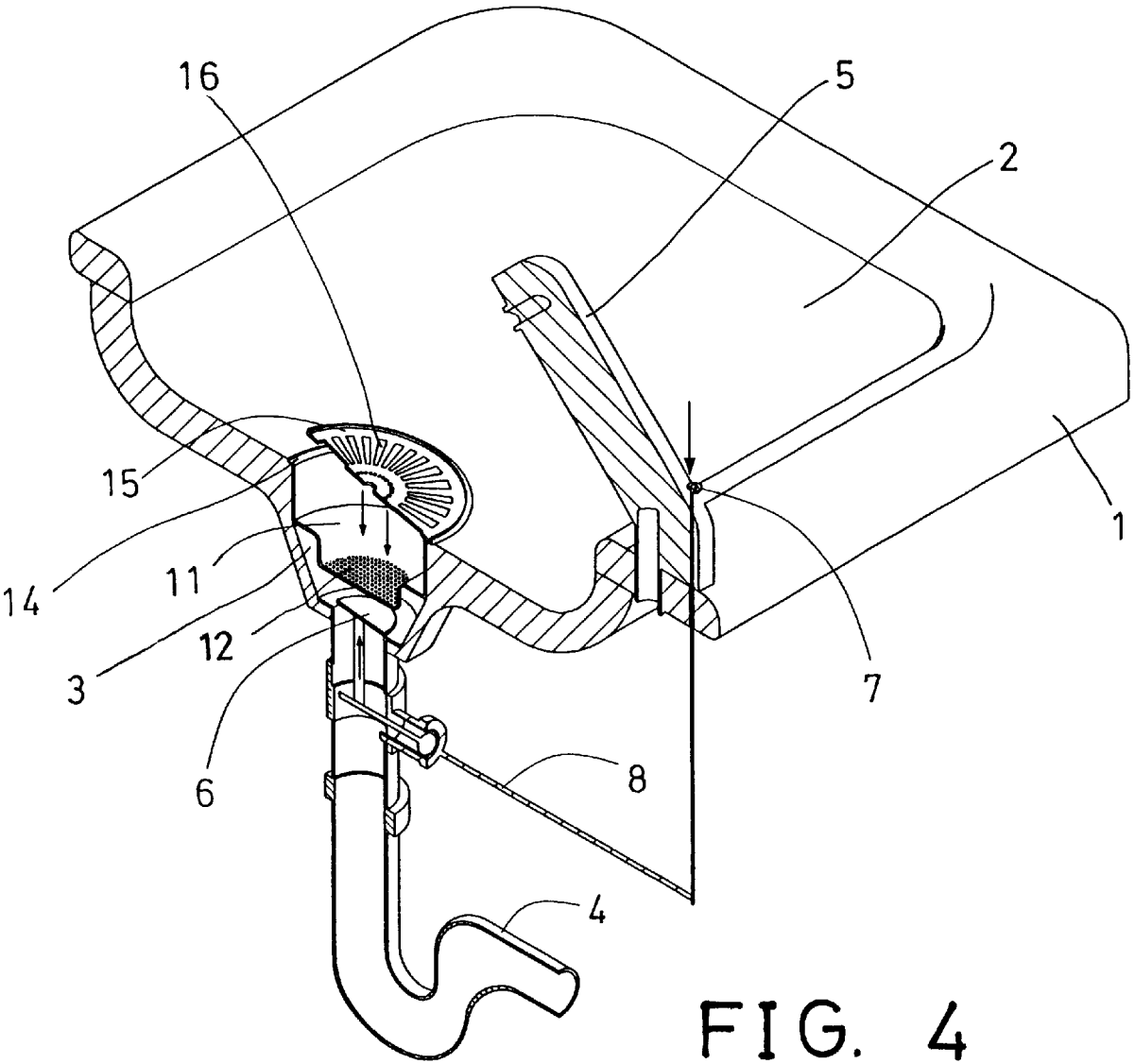
FIG. 4 is a partial perspective view similar to FIG. 3, illustrating the operation of the stop valve assembly.
Figure 6:
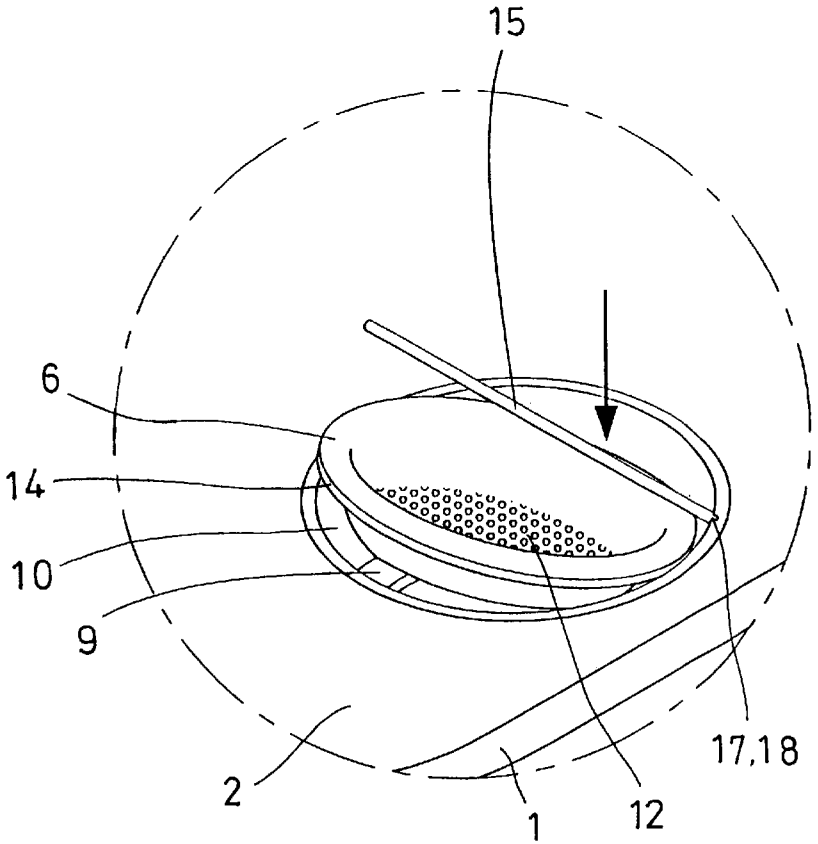
FIGS. 5 and 6 are enlarged partial perspective views, illustrating the operation of the stop valve assembly.
Figure 5:
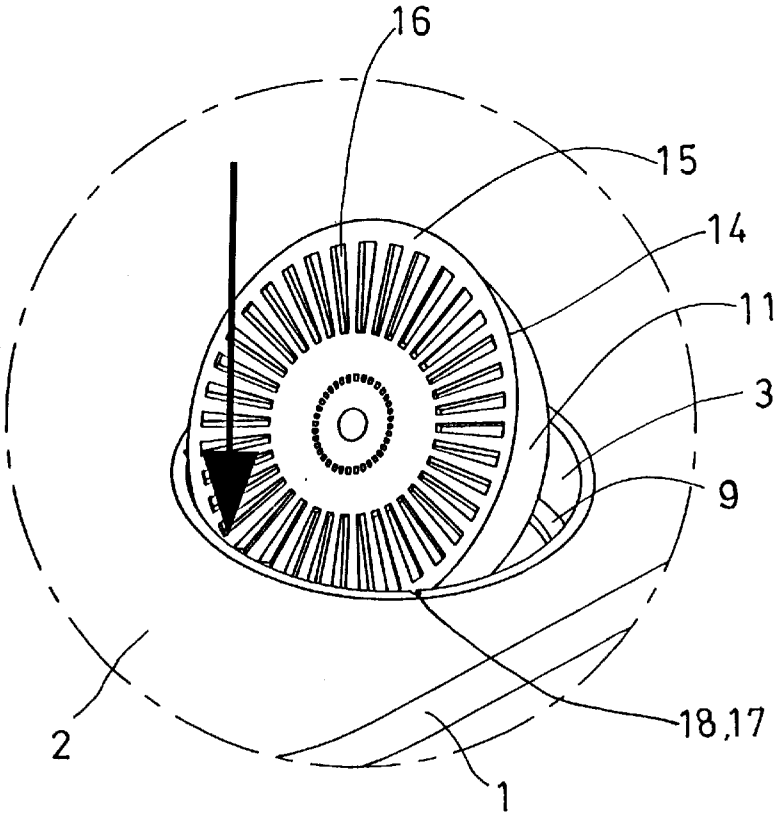

In operation, as shown in FIG. 4, the water may flow through the apertures 16 of the cover 15 and the orifices 12 of the casing 11, and the dirt may thus be filtered by both the cover 15 and the casing 11, and may be collected in the casing 11. As shown in FIGS. 5, 6, when the knob 19 of the cover 15 is depressed by the users, the casing 11 and the cover 15 may be slightly tilted or opened, for allowing the casing 11 and the cover 15 to be easily removed from the container 1 and to easily clean the dirt collected in the casing 11.

It is to be noted that the casing 11 may be easily removed from the container 1 for cleaning the collected dirt. In addition, the engagement of the pins 17 in the grooves 18 of the container 1 may prevent the cover 15 and the casing 11 from being over turned or rotated, and may limit the rotational movement of the cover 15 and the casing 11 relative to the container 1.

Accordingly, the stop valve assembly in accordance with the present invention includes a configuration or a casing for easily collecting the dirt and for allowing the collected dirt to be easily cleaned.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A stop valve assembly comprising:

a container including an outlet opening, a valve engaged in said outlet opening of said container, a casing received in said outlet opening of said container, and including a plurality of orifices formed therein for filtering purposes, a cover engaged on top of said casing and including a plurality of apertures formed therein, and means for pivotally securing said cover to said container, said pivotally securing means including at least one groove formed in said container, and at least one pin extended from said cover and engaged in said at least one groove of said container.

* * * * *